US009682562B2

(12) United States Patent
Castells et al.

(10) Patent No.: US 9,682,562 B2
(45) **Date of Patent: *Jun. 20, 2017**

(54) COLLECT PRINT SUBSTANCE

(71) Applicant: HEWLETT-PACKARD DEVELOPMENT COMPANY, L.P., Houston, TX (US)

(72) Inventors: Raimon Castells, Sant Cugat del Valles (ES); Antonio Monclus, Sant Cugat del Valles (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/746,550

(22) Filed: Jun. 22, 2015

(65) Prior Publication Data

US 2015/0283814 A1 Oct. 8, 2015

Related U.S. Application Data

(63) Continuation of application No. 13/878,988, filed as application No. PCT/US2010/052541 on Oct. 13, 2010, now Pat. No. 9,090,085.

(51) Int. Cl.

| | |
|---|---|
| ***B41J 2/185*** | (2006.01) |
| ***B41J 2/165*** | (2006.01) |
| ***B41J 3/407*** | (2006.01) |

(52) U.S. Cl.
CPC ..... *B41J 2/16523* (2013.01); *B41J 2/185* (2013.01); *B41J 3/4078* (2013.01)

(58) Field of Classification Search
CPC ..... B41J 2/16523; B41J 2/1721; B41J 2/185; B41J 3/4078
USPC ..... 347/22, 36, 88, 90
See application file for complete search history.

(56) References Cited

U.S. PATENT DOCUMENTS

| | | | | |
|---|---|---|---|---|
| 4,965,596 | A | 10/1990 | Nagoshi et al. | |
| 6,508,548 | B2 | 1/2003 | Erdtmann et al. | |
| 7,073,902 | B2 | 7/2006 | Codos et al. | |
| 7,347,542 | B2 | 3/2008 | Nichols | |
| 7,708,378 | B2 | 5/2010 | Katada | |
| 9,090,085 | B2 * | 7/2015 | Castells | B41J 3/4078 |
| 2005/0128244 | A1 | 6/2005 | Kulpa et al. | |
| 2012/0026261 | A1 | 2/2012 | Xie et al. | |

FOREIGN PATENT DOCUMENTS

| | | | |
|---|---|---|---|
| JP | 08-099414 | A | 4/1996 |

* cited by examiner

*Primary Examiner* — Jannelle M Lebron
(74) *Attorney, Agent, or Firm* — HP Inc—Patent Department

(57) ABSTRACT

Arrangement or method for collecting and heating print substance that passes through porous media in a printer.

20 Claims, 3 Drawing Sheets

Fig. 2
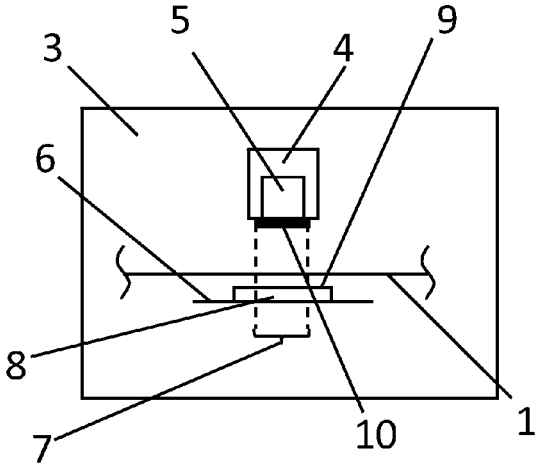
Fig. 1
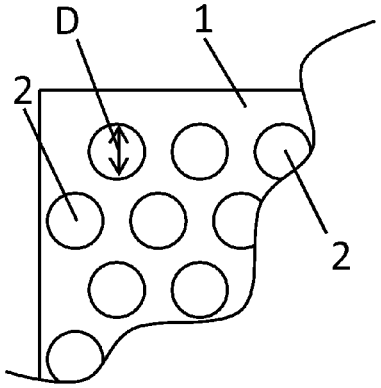
Fig. 4
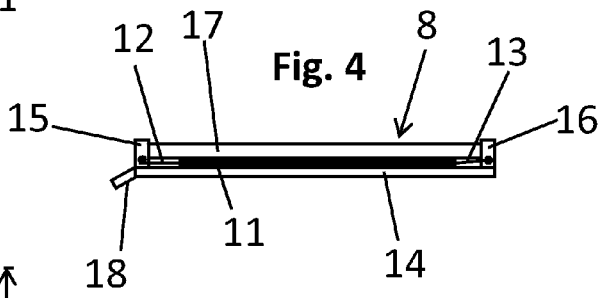
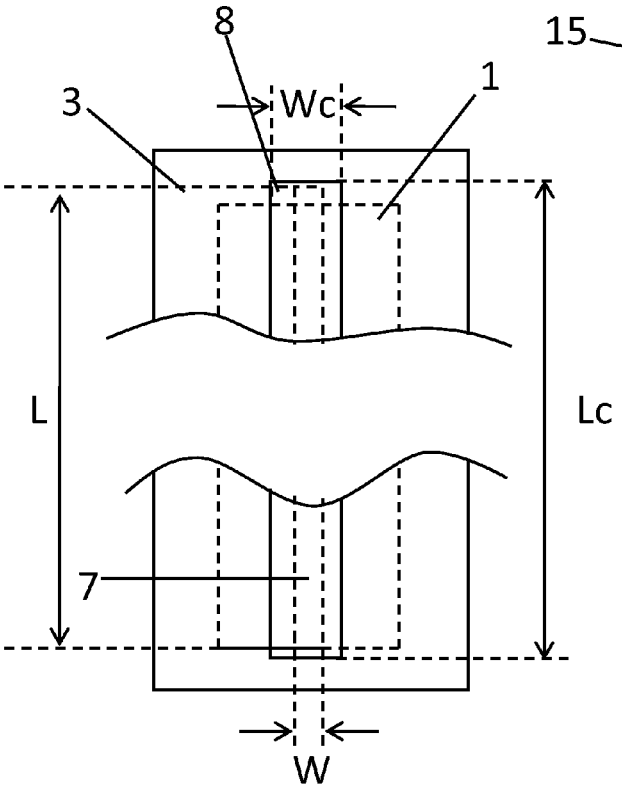
Fig. 3
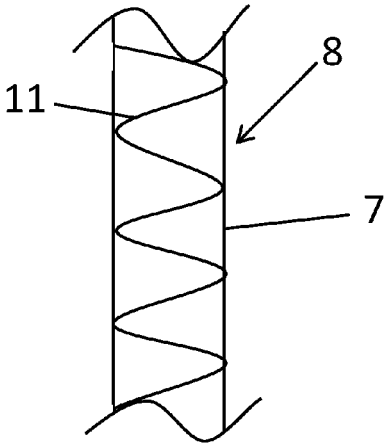
Fig. 5

COLLECT PRINT SUBSTANCE

BACKGROUND OF THE INVENTION

It is known to print on porous media, for example fabrics. When printing on porous media, ink tends to pass through the pores. In large format porous media, large volumes of ink may pass through the media, forming large quantities of waste ink. Cleaning the printer and disposing of the waste ink can be complicated. The printed media and some printer components can be permanently stained or damaged by the waste ink.

BRIEF DESCRIPTION OF THE DRAWINGS

For the purpose of illustration, certain embodiments of the present invention will now be described with reference to the accompanying diagrammatic drawings, in which:

FIG. 1 shows an embodiment of a portion of porous print media in a diagrammatic top view;

FIG. 2 shows a diagrammatic cross sectional side view of an embodiment of a printer with a collector;

FIG. 3 shows a diagrammatic top view of an embodiment of a collector in a printer;

FIG. 4 shows a diagrammatic cross sectional side view of an embodiment of a collector with a heat arrangement;

FIG. 5 shows a diagrammatic top view of an alternative embodiment of a heat arrangement;

DETAILED DESCRIPTION

Figure 6:
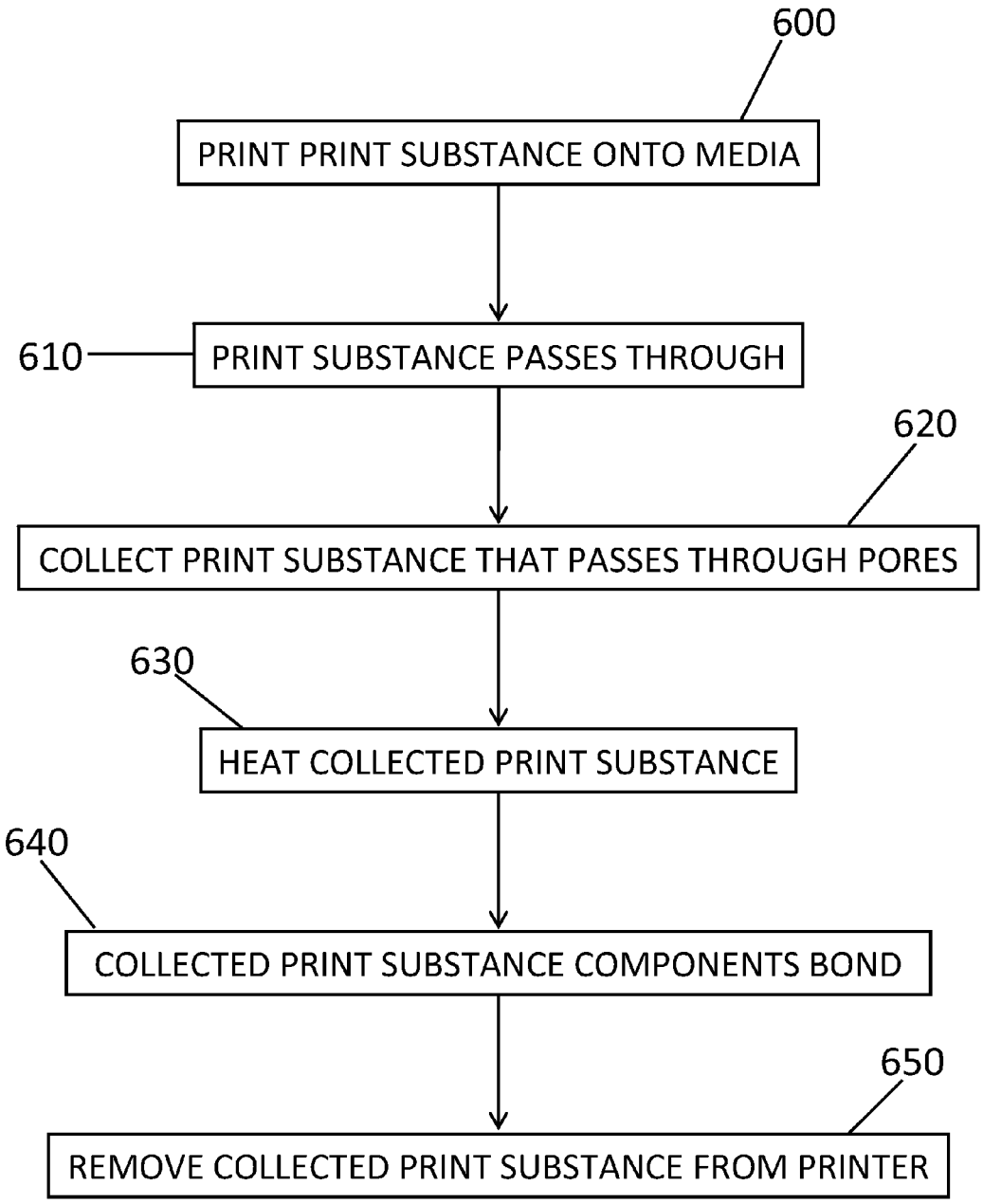
FIG. 6 shows a flow chart of an embodiment of a method of printing and collecting print substance.

In the following detailed description, reference is made to the accompanying drawings. The embodiments in the description and drawings should be considered illustrative and are not to be considered as limiting to the specific embodiment or element described. Multiple embodiments may be derived from the following description and/or drawings through modification, combination or variation of certain elements. Furthermore, it may be understood that other embodiments or elements that are not literally disclosed may be derived from the description and drawings by a person skilled in the art.

FIG. 1 shows a portion of porous media 1 in top view. The porous media 1 comprises pores 2 that may allow print substance, such as ink, to pass through during printing. An example of widely known porous media 1 is fabric, but many other porous media embodiments are used. In other embodiments, the porous media 1 comprises textile, paper, plastic and/or vinyl. The media 1 may be large format media 1.

The pores 2 may have any width, length, diameter D and/or shape. The minimum size of the pores 2 of this disclosure is such that print substance passes through. Pore shapes may include rounded shapes, cornered shapes, squared shapes, longitudinal shapes, etc. The pores 2 may extend between fibers, or may comprise cutouts, etc. In principle the print media 1 may comprise any quantity of pores 2.

In an embodiment, the print substance comprises ink. In a further embodiment, the ink comprises an aqueous ink and/or a latex ink. The print substance may comprise any substance used for printing on porous media 1. The print substance may include pigment based inks, dye based inks, coating, etc. The print substance may comprise toner material, including dry or liquid toner.

In an embodiment, the print substance comprises a color component, for example a pigment, and a bonding component, for example latex. The print substance may comprise a carrier component, for example water. In further embodiments, the print substance may comprise additive components and/or solvent components, including co-solvents. It is known that toners, dye based inks and pigment based inks comprise color components and bonding components. A latex ink embodiment comprises pigments as color components, latex as the bond component, water as a carrier component, and furthermore comprises additive and solvent components. In the field, the bond components such as latex may encapsulate and/or adhere to the color components. What is referred to in this disclosure as bonding may in the field also be referred to as coalescence or adhering.

FIG. 2 shows a diagram of an embodiment of a printer 3. The printer 3 comprises a printhead 4 for printing print substance. In this embodiment, the printer 3 comprises a large format printer, for example suitable for printing on print media 1 having a width of 1 meter or more, for example 3 meters or more, or 5 meters or more. In an embodiment, the printer 1 is an inkjet printer, wherein the print head comprises an inkjet print head, for example TIJ (thermal inkjet), PIJ (piezo inkjet) and/or CIJ (continuous inkjet), having a nozzle array 10. In a further embodiment, the printer 1 is suitable for printing latex ink and/or aqueous inks and/or pigment inks. In other embodiments, the printer 3 comprises a laser driven printer, a copying machine, etc. wherein the print head 4 may comprise a drum or an intermediate transfer member or the like.

The printer 3 may comprise a curing source 5, such as a heater and/or a UV (ultraviolet) radiation source, for curing the print substance on the media 1. The curing source 5 may heat the media 1 and/or the print substance printed onto the media 1. In this embodiment, the print substance comprises ink. In a further embodiment, the print substance comprises latex ink. It is common to heat the print media 1 and/or the ink when printing latex ink. It is also common to emit UV radiation onto latex ink for curing. The UV radiation may facilitate bonding of the components, and/or evaporation of the solvents. In some embodiments, the curing source 5 is attached to a scanning print head.

The printer 3 comprises a drive arrangement (not shown) for driving the media 1. The media 1 may be stretched by the drive arrangement during printing. The media 1 may be supported by a printer platen 6. The printer platen 6 may prevent that the print media 1 bends by gravity. The printer platen 6 may be provided under the print head 4.

The print area 7 is the area onto which the print head 4 prints, or is able to print. A print area 7 is shown in FIGS. 2 and 3. For example, the print area can be defined as the maximum print substance coverage area of the print head 4. In the shown embodiment, the print area 7 extends under the print head 4, but in principle the print area 7 may have any orientation or position, for example above or next to the print head 4. For example, drum roll and/or toner based printers may have a print area 7 that may be at least partly next to or above a print head 4.

In an embodiment, a width W of the print area 7 is dependent of the height of a nozzle array 10 of the print head 4, in FIG. 2 schematically depicted by a thick black line under the print head 4. Large format printers tend to have large nozzle arrays 10 with significant heights. In some embodiments, the height of the nozzle arrays 10 may be at least approximately 1 inch (2.5 centimeters), at least approximately 4 inches (10.2 centimeters), or at least approximately 8 inches (20.32 centimeters). The width W of the print area 7 may be approximately equal to the height of the nozzle array 10. In an embodiment, a length L of the print area 7 is dependent of a maximum print swath length, for example in case of a scanning print head 4, or a length of a print head 7, for example in case of a page wide array (PWA) print head 4. In large format printers, the length of the print area 7 may be 1 meter or more, 3 meters or more, 5 meters or more, etc.

The printer 1 comprises a collector 8. The collector 8 is arranged to collect print substance that passed through the pores 2. In use, the collector 8 extends under the media 1, so that all or most of the ink print substance passes through the pores 2 is collected. The collector 8 prevents that large amounts of print substance come into contact with printer parts. The collector 8 may be an exchangeable part. Alternatively, the collector 8 may be integrated with the printer 3. The collector 8 may be arranged to extend in or onto the printer platen 6, and under the media 1.

The width Wc and length Lc of the collector 8 is approximately equal to or more than the width W and length L, respectively, of the print area 7 to ensure proper collection of most or all of the print substance that passed through the media pores 2. In the shown embodiment, the length Lc of the collector 8 is longer than the length L of the print area 7, and the width Wc of the collector 8 is wider than the width W of the print area 7. The collector width Wc may be equal to or wider than the print area width W, for example at least approximately 1 inch (2.5 centimeters), at least approximately 4 inches (10.2 centimeters), or at least approximately 8 inches (20.32 centimeters). The collector length Lc may be equal to or wider than the print area length L, for example at least approximately 1 meter, at least approximately 3 meters, or at least approximately 5 meters.

The collector 8 comprises a heat arrangement 11 for heating the collected print substance. An embodiment of a heat arrangement 11 in a collector 8 is shown in FIG. 4. The heat arrangement 11 proactively heats the print substance that is collected by the collector 8. This may trigger bonding, hardening and/or evaporation of respective print substance components, thereby preventing further staining of or damage to printer parts or media 1. The embodiment of FIG. 4 comprises a tray shaped collector 8, comprising a heat film extending along the bottom, and substrate 17 over the heat film. This may allow for advantageous heating of print substance collected in and on the substrate 17. The substrate 17 may be arranged to absorb print substance and be disposable.

According to one possible explanation, by proactively heating the print substance in the collector 8, components of the print substance bond on the collector 8 so that the ability of the ink to stain other printer parts is reduced. The bonding may comprise adhering and/or hardening of color components and bond components. Remainders have shown to evaporate and/or be easily removable. The bonded components in the collector 8 can be removed from the printer 3 and/or collector relatively easy, for example by removing a print substance collecting substrate 17 that may be provided in the collector.

In an embodiment the collected print substance is heated without actively emitting UV radiation to it. The collected and heated print substance does therefore not fully cure. In certain embodiments, and especially in pigmented and/or aqueous inks such as latex ink, the ink hardens due to the heating. In further embodiments, after switching off the heat arrangement 11, liquid remainder may migrate to the top layer of the collected and hardened print substance. Such time period may be relatively long, such as 24 hours. A possible explanation for this liquid migration is that solvent components and/or other components do not completely evaporate due to lack of UV curing. Such non-hardened remainders have shown to be easily removable and do therefore not induce a risk of staining. Moreover, in practice the collected print substance may be disposed of before such remainder migrates to the top.

In an embodiment, the heat arrangement 11 is arranged to heat the collected print substance to a temperature of between approximately 40 and 95 degrees Celsius, for example between approximately 45 and 70 degrees Celsius. For reference, this temperature may be measured in a top layer of the collected print substance. For certain embodiments it is sufficient to heat the print substance to a minimum temperature of 45 or 50 degrees Celsius for the bonding components to start bonding. For example, latex ink components may bond around and/or between approximately 50 and 60 degrees Celsius. This has shown to be enough to harden the respective ink components. Therefore, the heating temperature may be limited to less than 95 to prevent possible deformation or tensions in the collector 8, and energy spilling.

The collector 8 may comprise a plate and/or tray shape. As can be seen from the embodiment, the collector 8 has a substantially longitudinal shape, corresponding to the print area 7 of the particular printer 3. The collector 8 has a relatively flat shape for extending under the media 1 of the printer 1, when the media 1 is mounted onto the printer 1. The collector 8 may have a height of several millimeters, or several centimeters, for example 3, 2, or 1 centimeters or less.

The heat arrangement 11 may comprise an electrical resistor. In an embodiment, the heat arrangement 11 comprises a thin film heater. For example, the film may be several millimeters high, for example 3, 2, or 1 millimeter(s) or less. The heat arrangement 11 may extend at least partly over a bottom 14 of the collector 8. In an embodiment, the heat arrangement 11 partly comprises a heat resistor, and partly a heat conductor.

In an embodiment, the heat arrangement 11 may be fed by a printer electricity source. The power source for the heat arrangement 11 may comprise a direct current supply. The power consumption may be kept moderately, of course depending on the size of the respective collector 8 and heat arrangement 11. In an illustrative embodiment, the collector 8 comprises a heat film of approximately 8 inch (20.32 centimeter) with a length of approximately 3.2 meter. Such embodiment may have a power consumption of approximately 400 Watt. Such power consumption may be enough to harden the collected print substance. 400 Watt is a small amount as compared to 10000 Watt, a typical power consumption of the total printer, a large part of which may be consumed by a heat radiation mechanism for heating and curing the printed ink. The heat arrangement 11 directly heats the collected substance and is therefore more efficient.

In the shown embodiment of FIG. 4 the heat arrangement 11 comprises electrodes 12, 13 connected to the heating circuit of the heat arrangement 11, in the shown instance a thin film heater. The electrodes 12, 13 may extend in, near and/or along one or two longitudinal side edges of the heat arrangement 11.

For illustrative purposes another heat arrangement 11 is shown in top view in FIG. 5. Here the heat arrangement 11 comprises heat resistor thread that may be arranged over the bottom 14 of the collector 8. The heat resistor thread may be arranged like a matrix, a sinusoid (an example of which is shown), a spiral, or in another manner to heat the full surface of the collector 8.

Turning again to FIG. 4, the heat arrangement 11 may comprise two upstanding walls 15, 16. Between the walls 15, 16 a substrate 17 may be arranged for collecting the print substance. The walls 15, 16 may be arranged to contain electrodes 15, 16 for the heat arrangement 11 and may extend approximately along the full length of the collector 8. The collector 8 may comprise an engagement member 18 to engage a certain printer part. The engagement member 18 may be arranged to position the collector 8 with respect to a certain printer part. The engagement member 18 may comprise a protrusion, wall, a hook, a magnet or the like. In an embodiment, the collector 8 and the printer 3 comprise interconnecting connections means such as holes, screws and bolts or the like.

The substrate 17 is arranged to collect the print substance. In use, the substrate 17 extends over and/or against the collector 8. The substrate 17 is arranged to allow the print substance to attach itself to the substrate 17. The substrate 17 may be arranged to absorb the print substance. In one embodiment, the substrate 17 comprises a porous or fiber-like structure. Examples of substrates 17 comprise foam, tape, textile web, paper, cardboard, etc. The substrate 17 is arranged to allow heat to be conducted through the substrate 17 so as to heat up most or all of the collected print substance. Relatively cheap, disposable and/or easily available substrates 17 may be used to collect the print substance. The substrates 17 may be exchanged within the collector 8.

FIG. 6 shows a flow chart of an embodiment of a method of collecting print substance. In block 600, print substance is printed onto the media 1. For example, the print substance may comprise an ink or toner. The print action produces an image or part of an image on the media 1. At the same time, as indicated by block 610, print substance passes through the pores 2 of the media 1.

As indicated by block 620, the print substance that passes through the pores 2 is collected by the collector 8. The collected print substance accumulates onto the collector 8. At least a first portion of the collected print substance may be absorbed by the substrate 17. The collected print substance is heated onto the collector 8, as indicated by block 630. The print substance is heated while it falls and accumulates on the collector 8. The print substance may be heated up to a temperature of between approximately 45 and approximately 90 degrees Celsius, as measured in a top layer of the collected print substance. In a further embodiment, the top of the collected print substance reaches a temperature of approximately 60 degrees Celsius. As indicated by block 640, the print substance is heated so that components of the print substance bond. The bond components may bond with the color components and harden, during which the collected print substance may attach itself to the substrate 17. At the same time, other components such as carrier components, solvent components and/or additive components may evaporate and/or form a relatively harmless remainder material.

As indicated by block 650, the collected print substance is removed from the printer 3. In an embodiment, the collected print substance is removed after having completed the printout. The printout may be a full large format printout that can consume relatively large volumes of ink. The risk of staining the bottom of the media 1 is reduced or removed due to the bonding of the components by heat. As described, the bonding may remove the staining ability and/or induce hardening and/or evaporation. The layers accumulating on top of the collector 8 may harden on top of each other with low or no risk of staining. The collected print substance does not need to be removed during printing. The collected print substance may be removed after one or more full printouts, or between one or several printouts. In addition, it is fairly easy to remove the collected print substance from the printer 3. In one embodiment, one just gets rid of the substrate 17 that has the collected print substance attached to it and/or absorbed in it.

Figure 7:
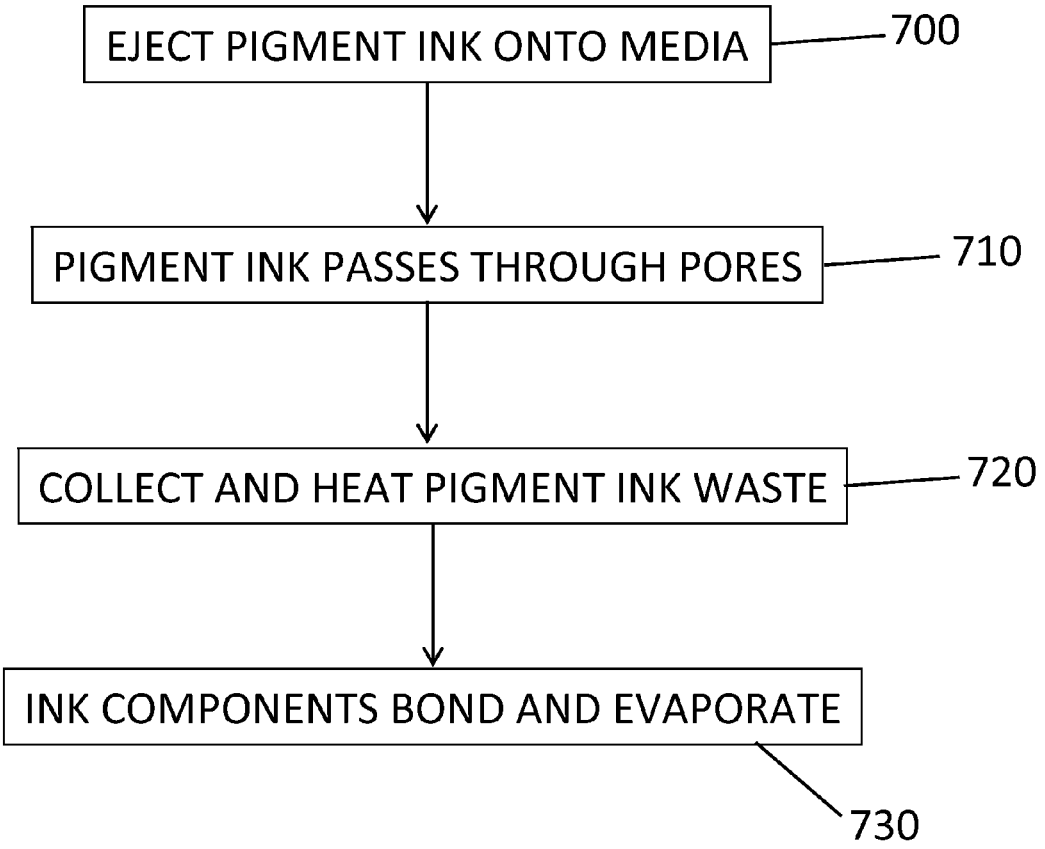
FIG. 7 shows a flow chart of an embodiment of heating waste ink.

FIG. 7 shows a flow chart of a further embodiment of a method of heating collected print substance, wherein the print substance comprises pigment and aqueous ink. A further embodiment of the pigment ink comprises water and latex, wherein the water forms more than half of the volume of the ink, for example between 60 and 90% of the total ink volume. In a first block 700, the pigment ink is ejected from inkjet nozzles, onto the porous media 1, for example along substantially the full width of the media 1. Portions of the ejected ink pass through the pores 2, as indicated by block 710, onto the collector 8. The collected pigment ink waste is heated in the collector 8, as indicated by block 720. Heating the pigment ink waste causes some components of the pigment ink to harden, as indicated by block 730, and most of the ink components to evaporate. In an embodiment, the latex bonds with the pigments adhering within and onto the substrate 17, while water and other remaining components mostly evaporate. A remaining component may comprise a solvent component, which may or may not fully evaporate. One theory is that some solvents or other remainders do not fully evaporate due to lack of active UV radiation. In an embodiment, the remainders, including the solvents, migrate to the outside of the hardened components a certain time period (e.g. 1-60 hours) after switching off the heating. It has been shown that this remainder can be easily removed from the media 1 and from the printer 3, should such be necessary. In practice the collected and hardened print substance may be disposed of before such migration occurs.

In this disclosure, it is not excluded that the collected and heated print substance may afterwards be decomposed, re-used and/or recycled for similar or other uses after being collected.

In certain embodiments, the print head 4 may comprise a toner drum, and/or an intermediate transfer member, for example for printing solid or liquid toner onto the media 1. In such embodiment, the collector 8 could extend under the print area 7, the print area 7 being the area where the print head 4 prints on the print media 1 and below. Also here, heating of the collected print substance can be advantageous, for example for bonding toner components.

In certain embodiments not shown in this disclosure, the collector 8 and/or the substrate 17 may be modular, so that the length and/or width can be adjusted by adding/removing modular components.

The above description is not intended to be exhaustive or to limit the invention to the embodiments disclosed. Other variations to the disclosed embodiments can be understood and effected by those skilled in the art in practicing the claimed invention, from a study of the drawings, the disclosure, and the appended claims. The indefinite article "a" or "an" does not exclude a plurality, while a reference to a certain number of elements does not exclude the possibility of having more elements. A single unit may fulfil the functions of several items recited in the disclosure, and vice versa several items may fulfil the function of one unit.

In the following claims, the mere fact that certain measures are recited in mutually different dependent claims does not indicate that a combination of these measures cannot be used to advantage. Multiple alternatives, equivalents, variations and combinations may be made without departing from the scope of the invention.

The invention claimed is:

1. A printing fluid collector for a printer arranged to collect waste printing fluid when printing onto porous media, the collector comprising:

a body having a flat and longitudinal shape for collecting waste printing fluid that has passed through the porous media, a heater, comprising an electrical resistor to generate heat, arranged along a length of the body for heating collected waste printing fluid, and an exchangeable substrate on the body, the substrate arranged to be heated by the heater such that waste printing fluid in contact with the substrate is solidified.

2. The collector of claim 1, wherein the body has a width greater than a width of the porous media.

3. The collector of claim 1, wherein the substrate is an exchangeable and disposable part.

4. The collector of claim 1, wherein the substrate is foam.

5. The collector of claim 1, wherein the substrate is fibrous.

6. The collector of claim 1, wherein the substrate comprises one of tape, textile web, paper and cardboard.

7. The collector of claim 1, wherein the substrate is reusable.

8. The collector of claim 1, wherein the substrate is porous.

9. The collector of claim 1, wherein the heater comprises a heat film extending over the body and the exchangeable substrate is positioned over the heat film.

10. The collector of claim 1, wherein the body comprises a tray having a bottom and upstanding walls surrounding the bottom.

11. The collector of claim 1, wherein the head comprises a heat resistor thread arranged in a pattern over the body.

12. The collector of claim 1, wherein the substrate comprises a fiber structure.

13. The collector of claim 1, wherein the substrate is comprised of a number of modular components such that the length or width of the substrate can be adjusted by adding or removing modular components.

14. A printer comprising the printing fluid collector of claim 1, the printing fluid collector being situated on an opposite side of a printing area from a printing fluid ejector; and wherein the heater is disposed to solidify collected printing fluid in the collecting area.

15. The printer of claim 14, wherein the collecting area has a length in a direction of travel of a print medium, wherein the length of the collecting area is longer than a length of the printing area in the direction of travel of a print medium.

16. The printer of claim 14, wherein the exchangeable substrate is disposed in the collecting area between the collector and the printing area.

17. The printer of claim 14, wherein the collecting area is wider than the printing area.

18. The printer of claim 17, wherein the collecting area is one to four inches wider than the printing area.

19. A method of operating the print fluid collector of claim 1 for managing the waste printing fluid of a printing process, the method comprising:

collecting waste printing fluid on the exchangeable substrate; and solidifying the waste printing fluid by heating.

20. A printing fluid collector for a printer arranged to collect waste printing fluid when printing onto porous media, the collector comprising:

a body for collecting waste printing fluid, from a printing fluid ejector, that has passed through the porous media;

a heater with the body for heating collected waste printing fluid;

an exchangeable substrate on the body, the substrate arranged to be heated by the heater such that waste printing fluid in contact with the substrate is solidified; and a releasable engagement member to releaseably engage a corresponding printer part to position the collector.

* * * * *